US007159722B2

(12) United States Patent
Berdelle-Hilge

(10) Patent No.: US 7,159,722 B2
(45) Date of Patent: Jan. 9, 2007

(54) SYSTEM AND METHOD FOR ITEM HANDLING

(75) Inventor: Peter Berdelle-Hilge, Constance (DE)

(73) Assignee: Siemens AG, München (DE)

( * ) Notice: Subject to any disclaimer, the term of this patent is extended or adjusted under 35 U.S.C. 154(b) by 0 days.

(21) Appl. No.: 10/933,454

(22) Filed: Sep. 3, 2004

(65) Prior Publication Data

US 2005/0056577 A1 Mar. 17, 2005

Related U.S. Application Data

(60) Provisional application No. 60/499,612, filed on Sep. 3, 2003.

(51) Int. Cl.
*B07C 5/00* (2006.01)

(52) U.S. Cl. ..... 209/630; 209/584; 414/404; 414/419; 414/281; 414/807

(58) Field of Classification Search ..... 209/630, 209/584, 706; 414/404, 281, 270, 419, 807; 198/465.4, 684, 682
See application file for complete search history.

(56) References Cited

U.S. PATENT DOCUMENTS

| | | | | |
|---|---|---|---|---|
| 3,184,061 A | | 5/1965 | Levy | |
| 4,067,459 A | | 1/1978 | Rozengauz et al. | |
| 4,756,401 A | * | 7/1988 | Kempton | 198/468.6 |
| 4,756,657 A | * | 7/1988 | Kinney | 414/281 |
| 5,346,351 A | * | 9/1994 | Priolo et al. | 414/277 |
| 5,385,243 A | * | 1/1995 | Jackson et al. | 209/509 |
| 5,467,892 A | | 11/1995 | Schlamp | |
| 5,472,309 A | * | 12/1995 | Bernard et al. | 414/807 |
| 5,634,760 A | * | 6/1997 | Anderson et al. | 414/268 |
| 5,714,454 A | * | 2/1998 | Thomas | 510/426 |
| 5,927,472 A | * | 7/1999 | Neef et al. | 198/465.4 |
| 6,135,697 A | * | 10/2000 | Isaacs et al. | 414/281 |
| 6,719,519 B1 | * | 4/2004 | Liehs | 414/419 |

FOREIGN PATENT DOCUMENTS

| | | |
|---|---|---|
| DE | 100 15 329 | 10/2001 |
| EP | 0 553 470 | 8/1993 |
| FR | 2 306 021 | 10/1976 |
| FR | 2 667 963 | 4/1992 |
| FR | 2 707 028 | 12/1994 |
| WO | WO 01/65431 | 9/2001 |

* cited by examiner

*Primary Examiner*—Kathy Matecki
*Assistant Examiner*—Terrell Matthews
(74) *Attorney, Agent, or Firm*—Siemens AG

(57) ABSTRACT

A system and method are set out for automatically extracting pods from a carousel shaped casing tower which include elements for engaging and moving the pods within the carousel while the carousel maintains its place. The pods travel on a track within the carousel which comprises six layers of pods. The extracting is performed in an extraction zone which may be located at least one end of the carousel while the loading of pods occurs at other locations. The pods include pockets for accommodating articles. The articles may be mail pieces.

5 Claims, 7 Drawing Sheets

SYSTEM AND METHOD FOR ITEM HANDLING

CROSS REFERENCE TO RELATED APPLICATIONS

The present application claims priority to provisional patent application 60/499,612, filed on Sep. 3, 2003, which is herein incorporated by reference.

BACKGROUND OF THE INVENTION

The present invention relates to article handling systems and methods and more particularly to a system and method for article extraction which provides a decrease in cost and an increase throughput efficiency over related prior art systems. As used throughout the application, articles refer to mail items, magazines, books and other such flat items. It is however within the scope of the present invention that other articles, as would be imagined by one skilled in the art, may be included in the definition of articles.

There are typically three main steps in article sorting: article singulation, article transportation to separate out output bins corresponding to appropriate destination addresses, and article extraction from the output bins to other devices for further handling. Such further handling may include polywrapping, re and/or further sorting, and other handling. The present invention is an improvement in the area of article extraction. However, in order to appreciate the scope of the present invention it is necessary to analyse the entire system and method employed in achieving the above mentioned advantages. To this end, a brief look at prior art systems and methods for article handling is useful.

FIG. 1 depicts a Pocket Sorter system which provides for simple merging with manual and/or DPS mail, the possibility of any kind of packaging at the end, and a simple sorting algorithm. This design's disadvantages include a tremendous number of active and controlled pockets, the necessity for an article sequencing process, and a short time window because of the late arrival time of sequenced articles. In operation, articles 10 arrive from an external feeder and scanner (depicted by arrow 12) into select individual pockets 14. The articles are then sorted into appropriate sections 16 of collection belt 18. Belt 18 is an endless loop about two rotating means 11 facilitating belt movement in the direction indicated by arrow 11. Provision is made for manual sorting 13 of articles on the belt 18 as well. The articles 10 are polywrapped 15 and stacked in a tray 17 for further processing.

FIGS. 2*a* and 2*b* depict a flat bed sorter arrangement which provides lower throughput performance per loading point, simple automatic emptying and packaging with mail compressing, and no need for autonomous vehicle technology because of the flat bed pockets. Disadvantages of the flat bed sorter include one shuttle loading point for each level of casing sections, greater length of shuttle track system in the casing sections, and existing impact of mail mix-grade and volume conditions on throughput. In operation, articles are introduced at respective feeders 20, 22 and transported 24 to endless sectioned (26) belts 28 which receive the articles 21 and stack them into trays 23. The design has a width (25) of about 23 meters and the belts are spaced about 150 mm apart.

The transporting of cartridges and/or articles is also disclosed in the prior art as exemplified by U.S. Pat. No. 6,135,697. FIG. 3 depicts a transport system 30 comprising a robotic arm 32 travelling along track 34 for affecting delivery of cartridge(s) 36 and/or articles 38 to appropriate compartments 31. The transport system 30 comprises a sorter 33 and autofeeder 35. The autofeeder 35 has several components including a feeding station 37, jogging edging station 39, queuing station 40, and docking station 42. Positioned atop the docketing station is a cartridge 36 filled with articles 38. The robotic arm 32 is used to relocate the cartridge 36 to a select compartment 31 of compartment array 44. The robotic arm 32 travels along a track 34 running parallel to the compartment array 31. As may be required, a buffer shelf 46 is included having a plurality of buffer compartments 48 arranged in an array 41.

The prior art systems rely upon a same device or combination of devices to both load and extract articles and/or cartridges from their respective storage areas. The device(s) must serve each storage area individually. Such loading and extraction processes are expensive and present engineering challenges. These and other burdens carry over into subsequent processes for article handling, including polywrapping, refeeding and the like.

SUMMARY OF THE INVENTION

It is an advantage of the present invention to provide a system and method for handling articles in a more efficient and cost effective manner than prior systems. Another advantage is to provide a system and method whereby post extraction processes are enhanced or at least maintained without additional burdens imposed by current extraction means. These and other advantages are achieved by the present system and method wherein stationary extraction zones are introduced and article storing compartments (PODs) are mobilized so as to be laterally displaced into the extraction zone where they, and the articles stored therein, are extracted. Within the extraction zone, post extraction functions are integrated with the extraction processes so as to maintain and/or increase efficiency and article throughput. The present system and method further define a loading zone that is different from the extraction zone. As such, it is possible to both load and extract while the carousel is not indexing.

The present system comprises a segmented casing tower arranged in a carousel design having two operating sections. A first operating section comprises at least one fixed tower portion having passages through which vehicles (ANTs) may pass and otherwise navigate to a select location and/or delivery point. A section operating section comprises at least one mobile casing accommodating a plurality of coaxial PODs therein. The PODs align with the vehicles and each are distributed over several levels. The first operating section further provides at least lateral support for the second operating section. Additionally, the casing tower provides support for both sections.

In operation, the ANTs pick up articles from feeders in a loading section, transport the articles by navigating the above passages to arrive at a particular POD. As the POD may be on one of several levels, ANT navigation is facilitated by various switches and lifts. Upon arrival at the POD, the ANT unloads an appropriate article(s) into the POD until the ANT's payload is empty. Once empty, the ANT returns to a loading section for the next payload. When extraction is desired, the carriers are indexed at least one length so as to relocate a carrier into the loading zone where the extraction occurs.

The extraction includes a platform on a lifting mechanism as well as POD engaging elements. The elements interface with mating receiving elements on the POD. In operation, the platform rises (or lowers) to the PODs level, the engaging elements engage and remove the POD from the carrier onto the platform. The platform then lowers (or raises) the POD to an appropriate level for further handling by post extraction processes. Such processes include polywrapping and manual handling.

BRIEF DESCRIPTION OF THE SEVERAL VIEWS OF THE DRAWINGS

The present invention and advantages thereof will be set out in more detail in the following detailed description taken in conjunction with the accompanying drawings wherein.

DETAILED DESCRIPTION OF THE INVENTION

Figure 1:
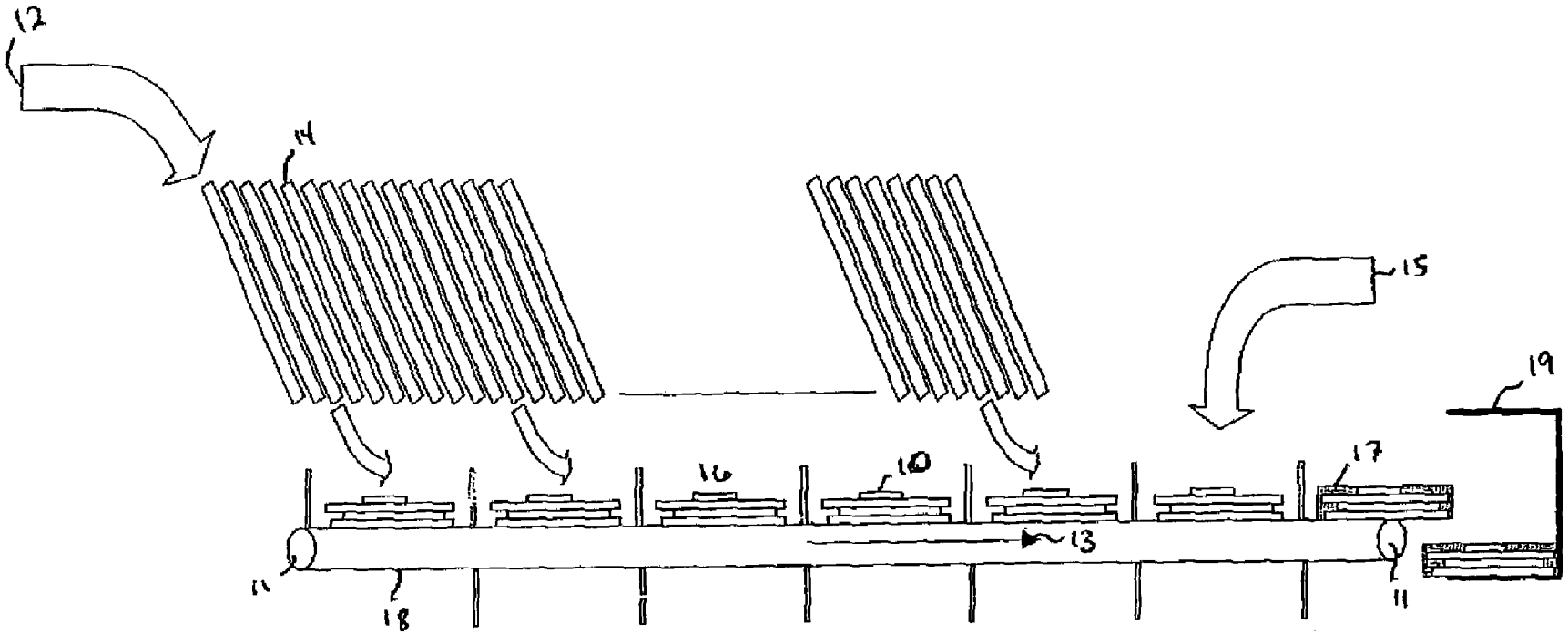
Figure 1 (Prior Art)
FIGS. 1–3 depict prior art systems.
Figure 2A:
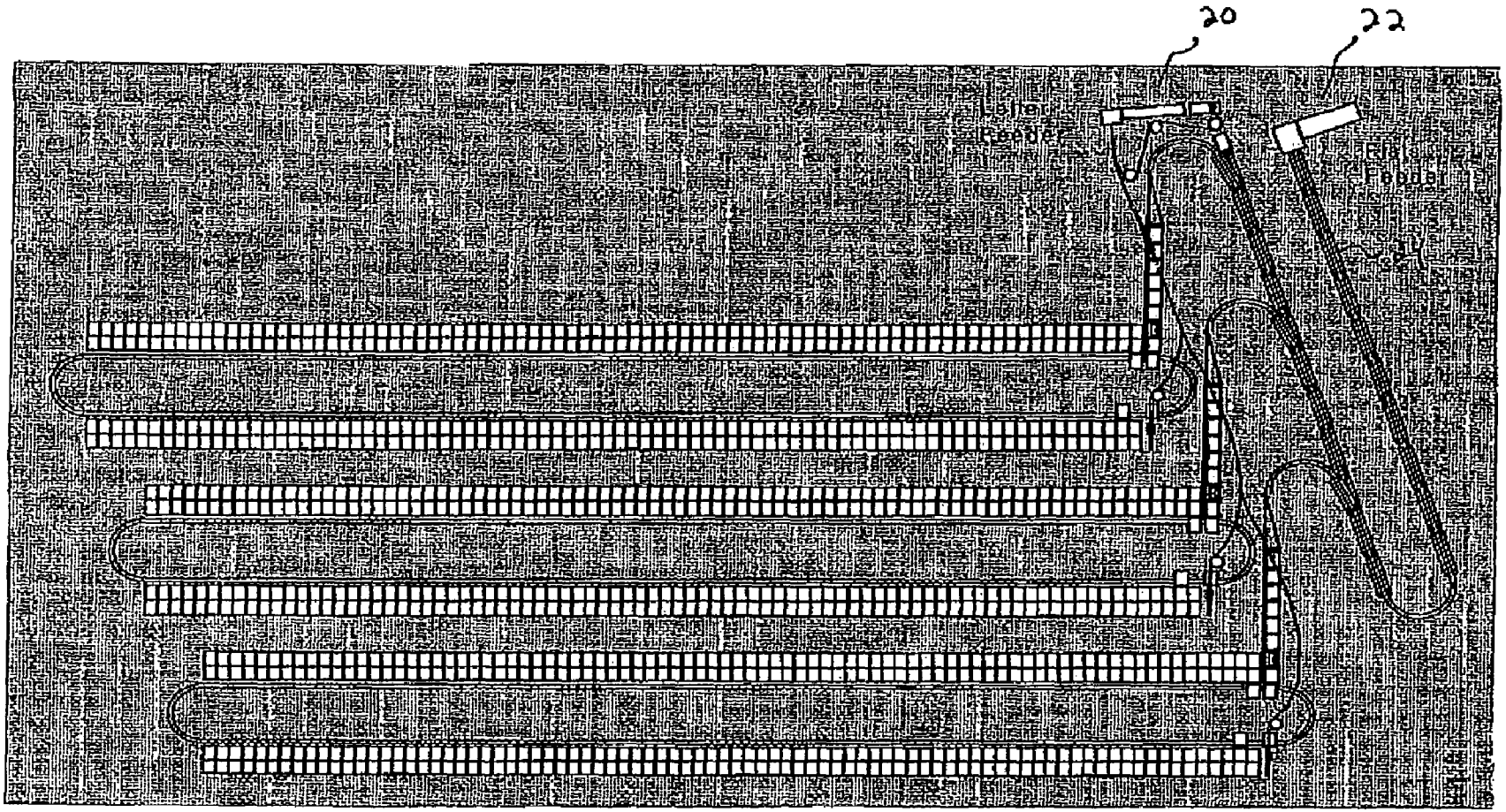
Figure 2a (Prior Art)
Figure 2B:
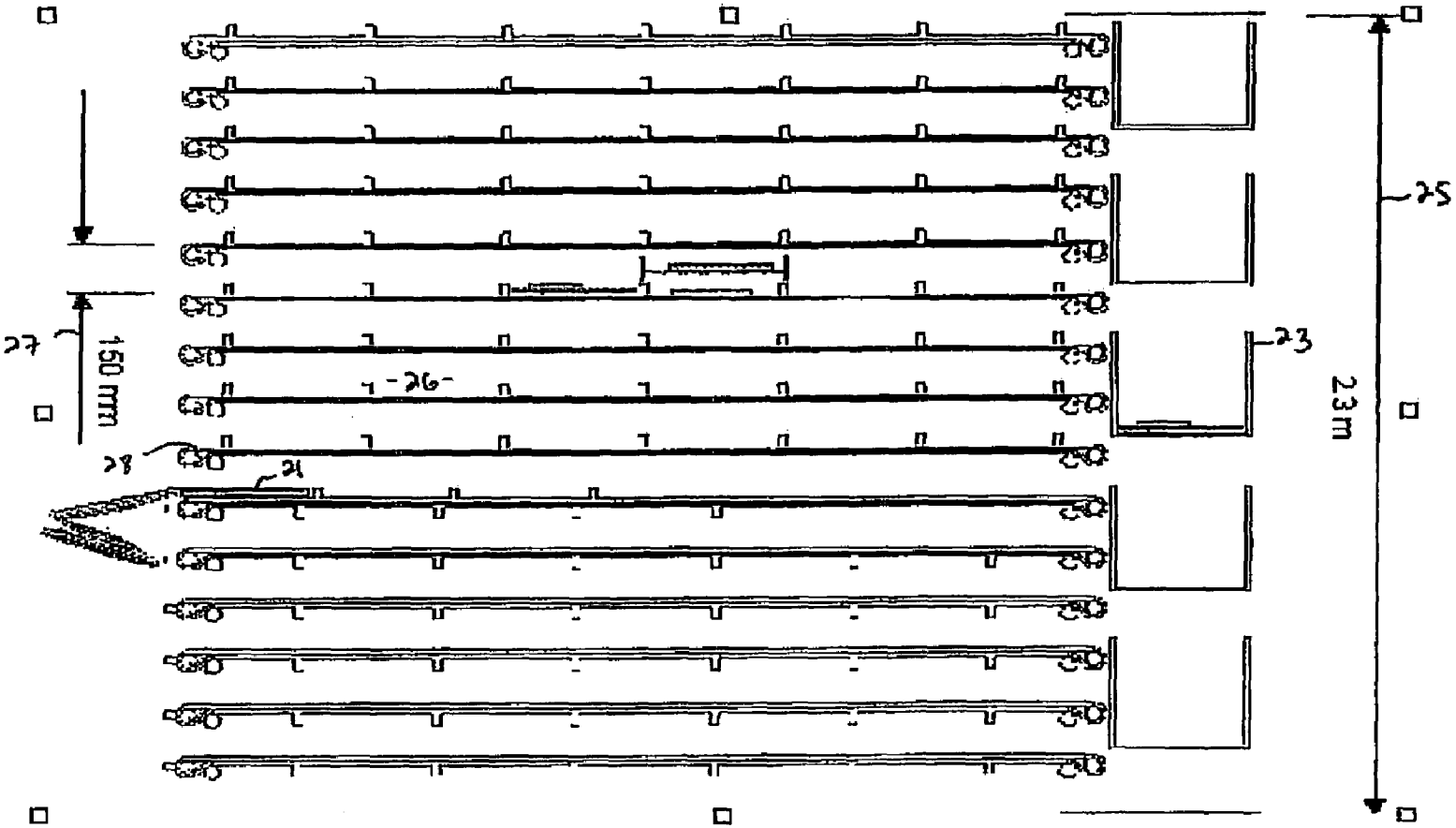
Figure 2b (Prior Art)
Figure 3:
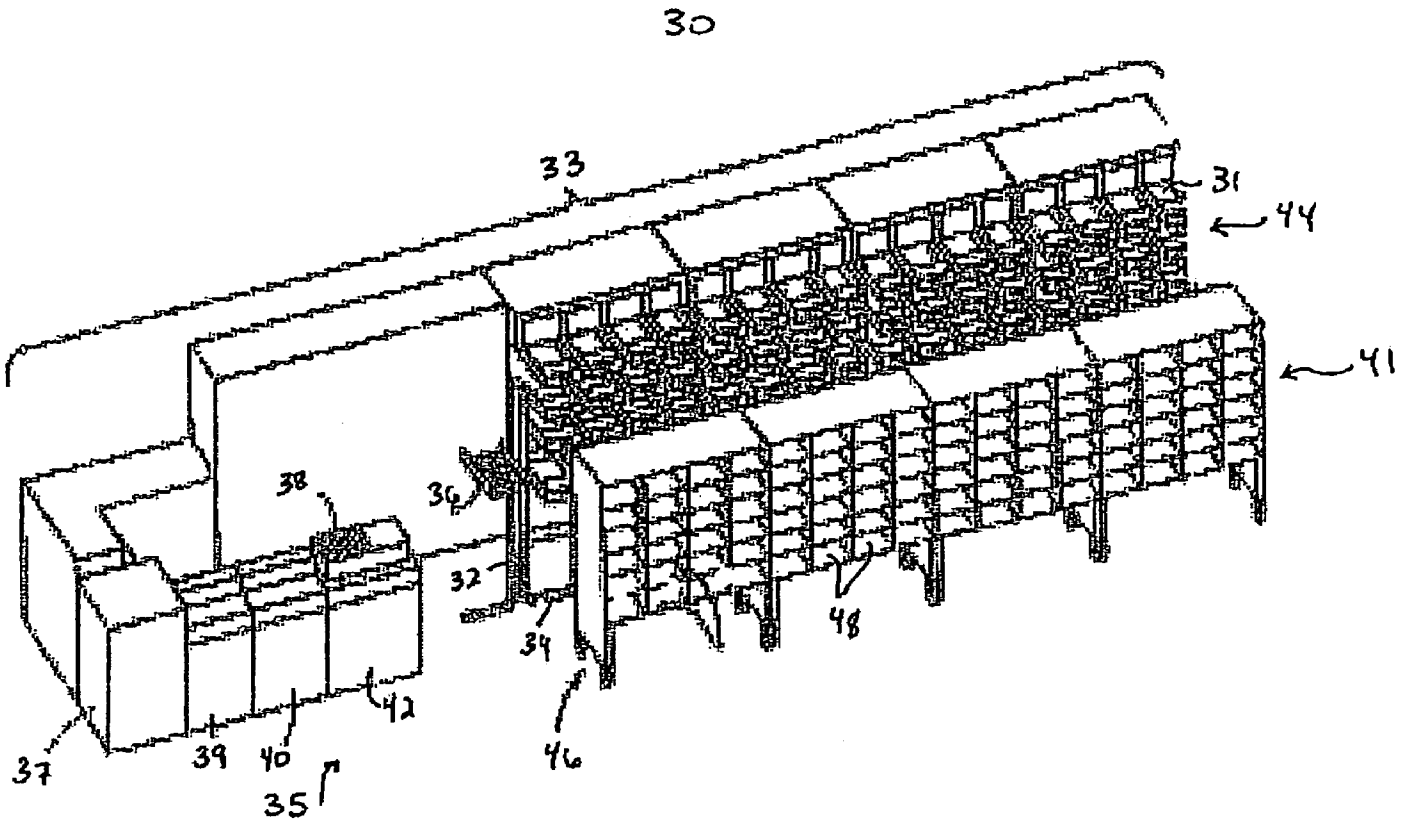
Figure 3 (Prior Art)
Figure 4:
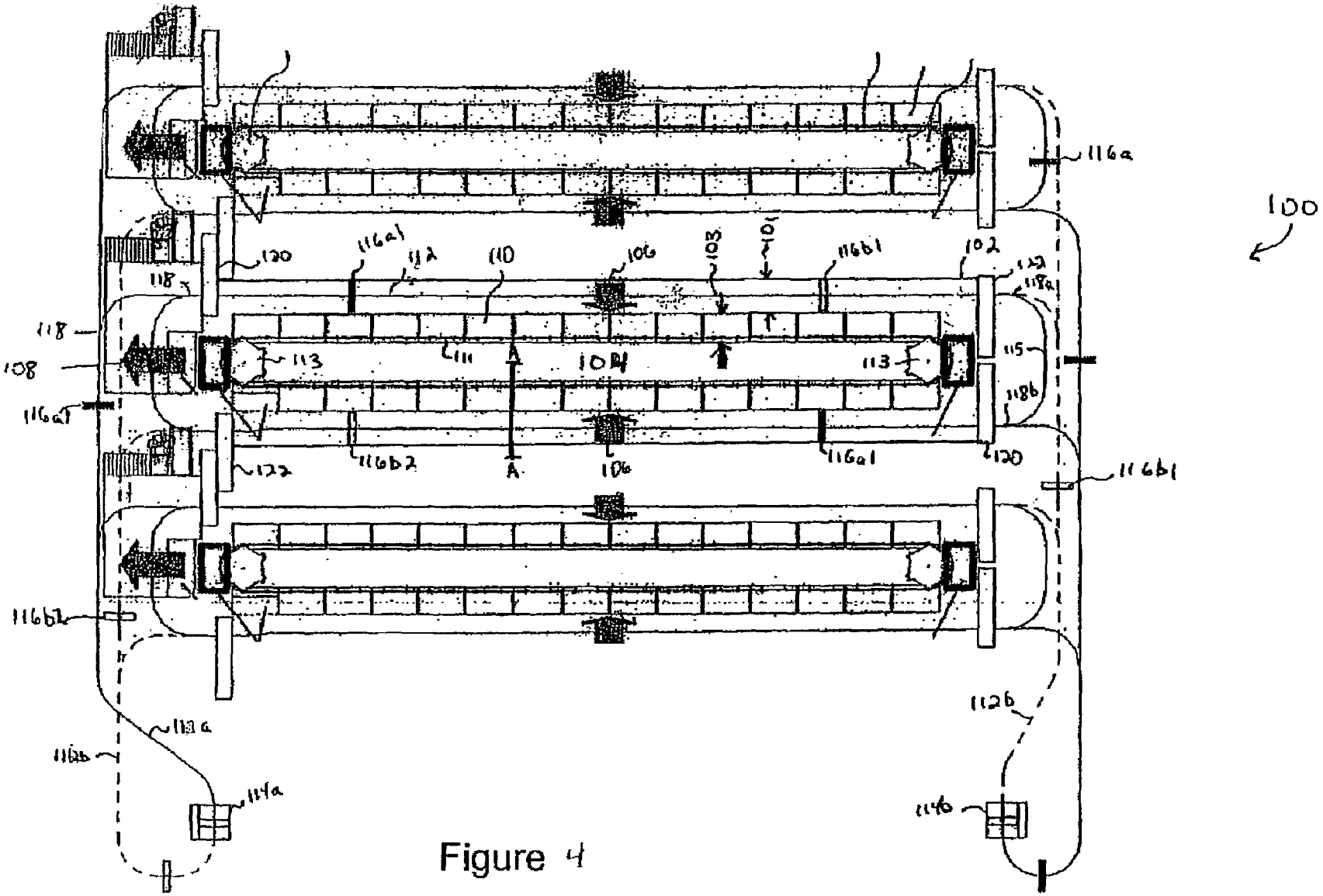
FIG. 4 depicts a schematic top view of the present system.

FIG. 4 depicts a schematic overview of the present invention. As shown, the present system 100 includes a plurality of casing towers 102 arranged in a closed loop carousel 104 arrangement. One possible shape includes an oval. The components and functionality of the carousels are equivalent, therefore for clarity purposes, only one of the carousels will be described in detail with the understanding that the description applies to all carousels comprising the present system. The number of carousels is a matter of design.

The casing towers 102 are segmented. Each segment defines two portions, an outer static vehicle frame 101 and an inner carrier opening 103. The casing tower includes two zones, a loading zone indicated by arrows 106 and an extraction zone indicated by arrow 108. The loading zone runs along the length of the carousel, while the extraction zone is located at the carousel end or pinnacle. The casing tower 102 includes 6 vertical levels. The number of levels and zones is a matter of design. For example, the extraction zone 108 may be located at both carousel ends.

Outer frame 101 includes a number of vertically displaced coaxial vehicle passages equal to the number of levels of the tower 102 (in this embodiment six). The passages are sufficiently sized so as to accommodate a delivery vehicle or ANT 116 and a track 112 therein. The track 112 may be a monorail and the ANT may comprise sufficient means so as to run along the monorail. The ANTs may be autonomous and self powered. Alternative embodiments of ANTs may also be used in the present invention. The passage may additional include a floor upon which the ANTs may support themselves. The track runs about the casing tower 102 as well as connects the casing tower with other towers and two loading zones 114*a* and 114*b*. The track carrying ANTs from a loading zone to a tower is depicted as a solid line (112*a*), while the track carrying ANTs from a tower to a loading zone is depicted as a dashed line (112*b*). Inner carrier opening 103 defines an opening within casing tower 102 in which a plurality of carriers 110 run. The carriers run suspended from a track and connected to one another by linkages. The combination of linkages and track are labelled 111 and will be discussed in more detail with respect to FIG. 5. Each carousel includes a pair of opposing coq wheels 113, designed to engage the carriers and, by rotating, laterally displace the carriers along their track. Each carrier includes article containers or PODs (145, FIG. 5) equal to the number of levels of the tower (in this embodiment, six PODs). The PODs are vertically distributed within the carrier so as to align with each of the six levels of the tower 102 and vehicle passages. Each POD includes at least one pocket (160, FIG. 6) to receive at least one article.

To facilitate lateral displacement of the ANTs, the system includes a plurality of switches 118. To facilitate downwards displacement of the ANTs, the system includes divert elevators 120. To facilitate upwards displacement of the ANTs, the system includes merge elevators 122.

Delivery of an article to a pocket will now be described. An ANT approaches a loading station and receives articles to be delivered. The destination of the articles is known in advance. ANTs including articles therein are darkened (116*a*) and empty ANTs are depicted whited out (116*b*). Using loading zone 114*a* as a starting point, an ANT picks up articles and travels to a destination carousel (herein the middle carousel). The ANT 116*a*1 is fully loaded and travelling on one level 112*a*. The track outside the carousels runs on one level only. At switch 118, the ANT 116*a*1 is horizontally diverted to the middle carousel. The ANT then encounters divert elevator 120 which vertically raises the ANT to the destination level—the level on which the destination pocket in the destination POD resides. Upon reaching the destination level, the ANT disembarks from the divert elevator 120 and runs along destination level track 112 until the ANT reaches its destination POD(s) and destination pocket(s) and unloads its cargo therein. The number of articles stored with the ANT varies by design. Assuming the destination pocket(s) to be along one side of the casing tower 102, the ANT will empty its payload in a single pass leaving it now empty (116*b*1). The ANT then enters merge elevator 122 which raises the ANT to non-carousel track level thereby allowing ANT 116*b*1 to proceed to second loading zone 114*b*, along track 112*b*, to pick up a new payload and repeat the above steps and route. Should the ANT 116*a*1 require access to the other side of the carousel, it is horizontally diverted 118*a* to a short cut 115 and horizontally diverted again 118*b*. The ANT 116*a*1 once again makes deliveries until it is empty (116*b*2). This assumes the remaining pockets to be on this side of the carousel. If empty, the ANT 116*b*2 again enters a merge elevator 122 and is raised to non-track level 112*b* on the left side of the figure and proceeds back to loading zone 114*a*. Should the ANT be required to visit additional carousels during a single run it will be horizontally and vertically diverted as set out above.

Figure 5:
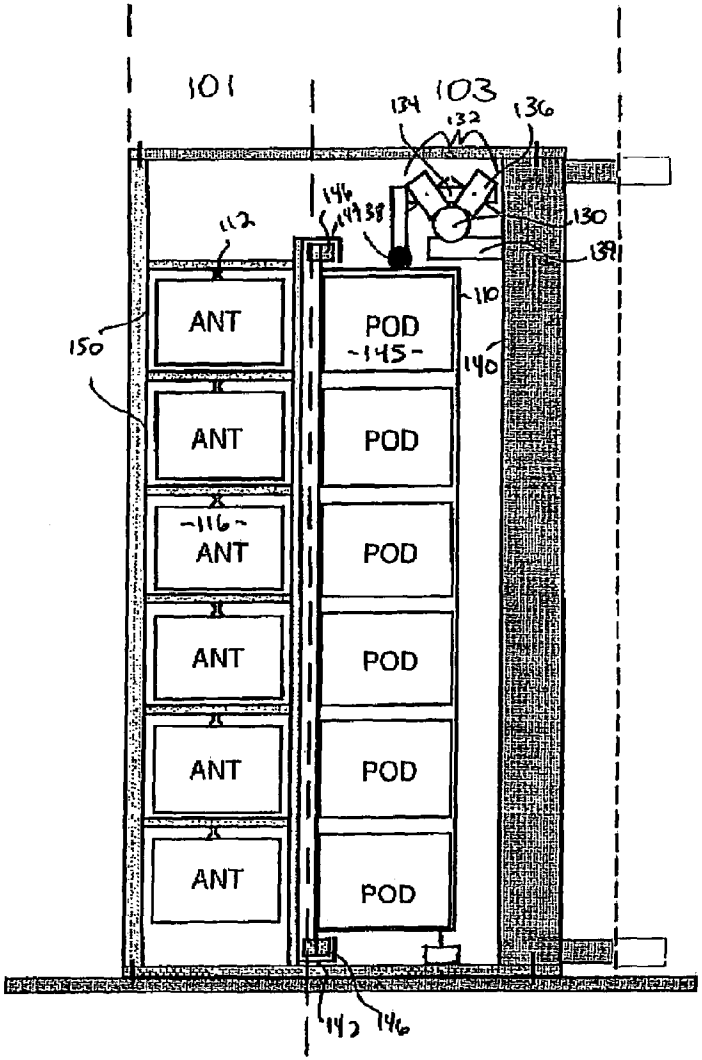
FIG. 5 depicts a schematic cross section of the present system.

FIG. 5 depicts a cross sectional view of the casing tower 102 along line A—A. FIG. 5*a* depicts the cross section with a portion of the casing tower removed. As depicted, inner carrier opening 103 includes carrier 110 is suspended from track 130 via support means 132 comprising a cross brace 134 and two rollers 136 angled to rotatably engage track 130. The support means further includes a pivot connection 138 with the top of the carrier 110. Rail 130 rests upon a rail support 139 itself connected to a side 140 of the casing tower. Accordingly, the carrier 110 runs in the inner carrier opening 103 via the aforementioned support system. Alternatively, the support means, comprising like elements may be located below the carrier thereby supporting it from below. The carrier 110 includes six vertical co-axial PODs 145. The static vehicle frame 101 remains fixed in place and defines six vertical co-axial vehicle passages 150. Within each vehicle passage runs monorail 112 from which ANT 116 is suspended. Each vehicle passage, per level, is co-planar with a POD thereby facilitating delivery by the ANT to a POD. The static vehicle frame further includes a lateral support 142 frame in which a roller, suspended from carrier 110, runs. Accordingly, the static frame, via lateral support 142, provides for lateral guidance to the carrier 110.

Figure 6:
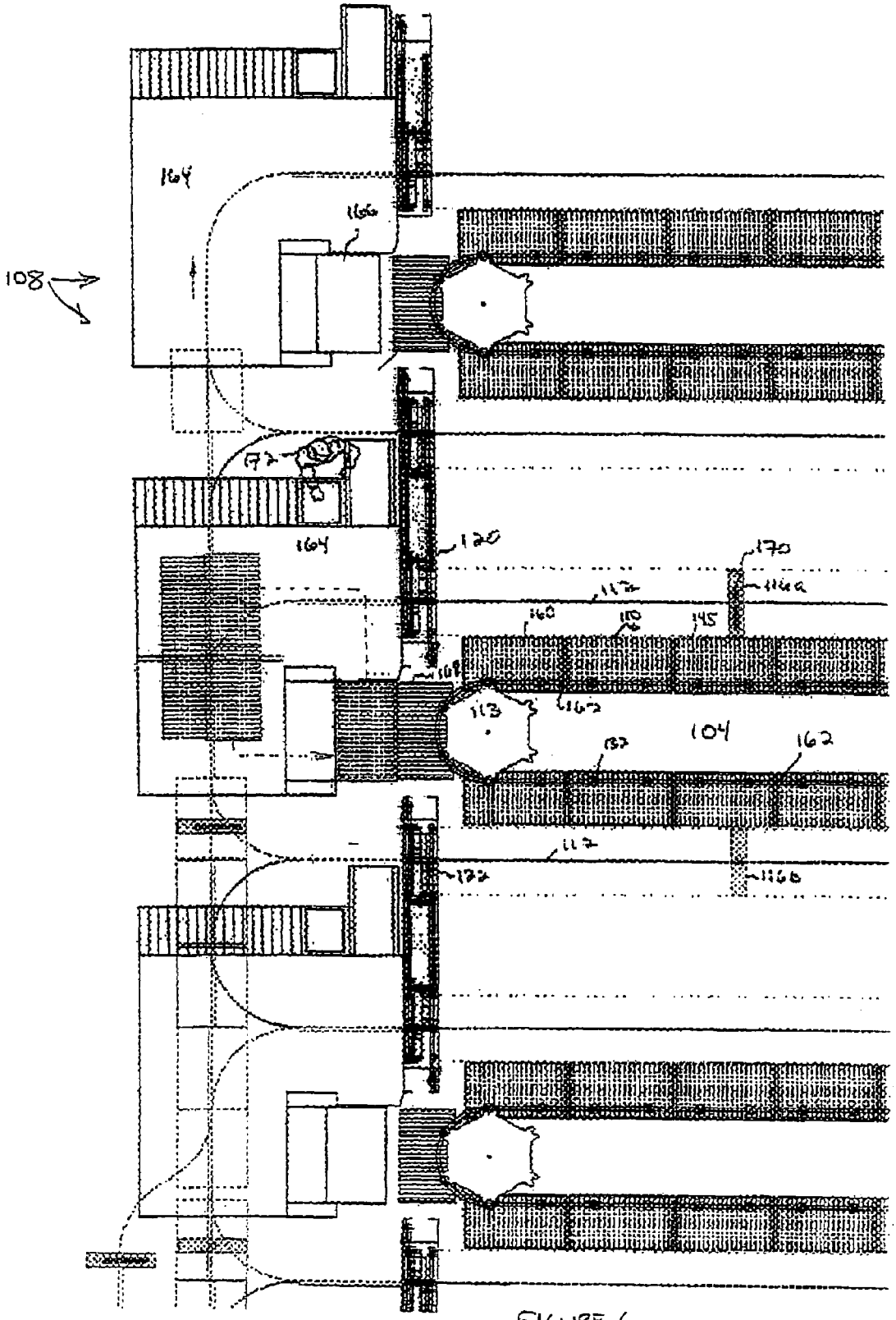
FIG. 6 depicts an enlarged portion of the extraction zone.

Extraction of a POD will now be discussed with reference to FIG. 6. FIG. 6 depicts an enlargement of extraction zone 108. As shown carousel 104 includes a plurality of carriers 110 comprising PODs 145 themselves comprising pockets 160. A loaded ANT 116*a* delivers articles 170 arriving from divert elevator 120 running along track 112, while an empty ANT 116*b* runs along track 112 enroute to a merge elevator 122. Coq wheel 113 is depicted engaging carrier support 132. Adjacent carriers 110 are coupled together via coupling 162. The extraction zone 108 includes an extraction module 164 comprising a POD lift 166. The POD lift includes means known in the art to rise and fall and align with a select level of the carousel. Additionally, the POD includes means for laterally displacing towards and away from the carousel as well as POD attaching elements for physically engaging the POD. Likewise, the POD includes mating means for mating with the engaging means of the POD. The aforementioned means may comprise any elements sufficiently engineered to accomplish the aforementioned and subsequent actions as would be known to one skilled in the art.

POD extraction occurs when no deliveries within the loading zone are made. Upon this occurrence, the coq wheel 113 is rotated so as to index the carriers by one carrier in the direction of coq wheel rotation. To facilitate movement of the carrier, the POD lift 166 is sufficiently spaced from the POD 10. As depicted, POD 168 is introduced into the extraction zone proximate to the POD lift 166. Once in place, article delivery in the loading zone may resume. The POD lift 166 extends and rises so as to align itself with a POD. The lift engages and retracts the POD from the carrier supporting it on the lift itself. The lift then displaces so as to bring the POD coplanar with the extraction module 164 whereupon the POD is removed from the lift and appropriately directed for further processing 172. Further processing may include manual handling, polywrapping, and the like.

The invention being thus described, it will be obvious that the same may be varied in many ways. Such variations are not to be regarded as a departure from the spirit and scope of the invention, and all such modifications would be obvious to on skilled in the art are intended to be included within the scope of the following claims.

I claim:

1. A system for sorting articles, comprising at least one segmented casing tower, said tower comprising:

at least one moveable carrier, including:

carrier moving means, and at least one article storage means:

a static frame arranged proximate to said carrier, said static frame including:

at least one vehicle passage arranged to facilitate positioning of a vehicle proximate to an article storage means, and a loading zone defining a first location area where articles are loaded into said storage means; and an extraction zone defining a second location where said at least one article storage means is removed from said carrier, wherein said at least one carrier moving means comprises an overhead rail and a carrier support, said carrier support comprising a pivot connection with said carrier, at least one roller rotatably associated with said rail, and a cantilever running between said pivot connection and roller such that said carrier hangs below said rail and is displaceable along said rail.

2. The system according to claim 1, wherein said at least one carrier comprises a plurality of carriers and said system further comprises a linkage connecting carrier supports of adjacent carriers.

3. A system for sorting articles, comprising at least one segmented casing tower, said tower comprising:

at least one moveable carrier, including:

carrier moving means, and at least one article storage means;

a static frame arranged proximate to said carrier, said static frame including;

at least one vehicle passage arranged to facilitate positioning of a vehicle proximate to an article storage means, and a loading zone defining a first location area where articles are loaded into said storage means; and an extraction zone defining a second location where said at least one article storage means is removed from said carrier, wherein said at least one carrier moving means comprises a rail and a carrier support, said carrier support comprising a pivot connection with said carrier, at least one roller associated with said rail, and a cantilever running between said pivot connection and roller such that said carrier rests on said rail and is displaceable along said rail.

4. The system according to claim 3, wherein said at least one carrier comprises a plurality of carriers and said system further comprises a linkage connecting carrier supports of adjacent carriers.

5. A system for sorting articles, comprising at least one segmented casing tower, said tower comprising:

at least one moveable carrier, including:

carrier moving means, and at least one article storage means;

a static frame arranged proximate to said carrier, said static frame including;

at least one vehicle passage arranged to facilitate positioning of a vehicle proximate to an article storage means, and a loading zone defining a first location area where articles are loaded into said storage means; and an extraction zone defining a second location where said at least one article storage means is removed from said carrier, wherein said at least one carrier moving means comprises an overhead rail and a carrier support, said carrier support comprising a pivot connection with said carrier, at least one roller rotatably associated with said rail, and a cantilever running between said pivot connection and roller such that said carrier hangs below said rail and is displaceable along said rail, and said system further comprises a coq wheel located at each pinnacle of said oval and arranged to rotatably engage each of said carrier support so as to impart a lateral force thereupon, said lateral force translating into lateral movement of said carrier along said rail.

* * * * *